US011660495B2

(12) United States Patent
Paton

(10) Patent No.: US 11,660,495 B2
(45) Date of Patent: May 30, 2023

(54) ANTI-SLIP YOGA RUGS

(71) Applicant: Kerry Roth Design, LLC, Minneapolis, MN (US)

(72) Inventor: Kerry Roth Paton, Minneapolis, MN (US)

(73) Assignee: Kerry Roth Design, LLC, Minneapolis, MN (US)

( * ) Notice: Subject to any disclaimer, the term of this patent is extended or adjusted under 35 U.S.C. 154(b) by 136 days.

(21) Appl. No.: 17/180,135

(22) Filed: Feb. 19, 2021

(65) Prior Publication Data

US 2021/0346751 A1 Nov. 11, 2021

Related U.S. Application Data

(63) Continuation of application No. 15/905,553, filed on Feb. 26, 2018, now abandoned, which is a continuation-in-part of application No. 15/678,359, filed on Aug. 16, 2017, now abandoned.

(60) Provisional application No. 62/376,099, filed on Aug. 17, 2016.

(51) Int. Cl.

| | |
|---|---|
| ***A63B 21/00*** | (2006.01) |
| ***D03D 3/08*** | (2006.01) |
| ***A63B 71/00*** | (2006.01) |
| ***D03D 15/258*** | (2021.01) |

(52) U.S. Cl.

CPC ..... *A63B 21/4037* (2015.10); *A63B 71/0054* (2013.01); *D03D 3/08* (2013.01); *D03D 15/258* (2021.01); *A63B 2209/00* (2013.01); *D10B 2201/02* (2013.01); *D10B 2503/04* (2013.01); *D10B 2507/00* (2013.01)

(58) Field of Classification Search

CPC ..... A63B 21/4037; A63B 71/0054; A63B 2209/00; D03D 3/08; D03D 15/258; D03D 15/58; D10B 2503/04; D10B 2201/02; D10B 2507/00; A47G 9/06; A47G 9/062; A47G 27/0212; A47G 27/0237

See application file for complete search history.

(56) References Cited

U.S. PATENT DOCUMENTS

| | | | | |
|---|---|---|---|---|
| 1,970,959 | A * | 8/1934 | Gauntlett | A47G 27/0218 428/95 |
| 6,663,537 | B2 * | 12/2003 | McCoy | A63B 6/00 482/148 |
| 6,935,382 | B2 * | 8/2005 | Buckley | A63B 21/4037 139/393 |
| 6,961,969 | B2 | 11/2005 | Nichols | |

(Continued)

OTHER PUBLICATIONS

Kitchen Daily, "Why Stainless Steel Erases Garlic's Aroma," 10 pages, Mar. 13, 2012, Huffpost, Retrieved from internet https://www.huffpost.com/entry/eliminating-garlic-smell_n_1341413?guccounter=1 (Year: 2012).*

*Primary Examiner* — David R Hare
*Assistant Examiner* — Alison N Labarge
(74) *Attorney, Agent, or Firm* — Fox Rothschild LLP

(57) ABSTRACT

An anti-slip yoga rug comprising a fabric weave including a weft and a warp. The anti-slip yoga rug also comprising a topside grip, the topside grip including an anti-slip ridge woven into the fabric weave, and a bottom-side grip. The anti-slip yoga rug further including an edger that circumferentially surrounds one or more edges of the anti-slip yoga rug and wherein the bottom-side grip mechanically connects to an underside of the edger.

15 Claims, 8 Drawing Sheets

(56) References Cited

U.S. PATENT DOCUMENTS

| | | | | |
|---|---|---|---|---|
| 7,069,607 | B2 | 7/2006 | Nichols | |
| 7,137,157 | B2 | 11/2006 | Nichols | |
| 8,631,833 | B2 * | 1/2014 | Garbarino | D06H 5/00 139/420 R |
| 9,302,152 | B2 | 4/2016 | Blum et al. | |
| 9,463,348 | B2 | 10/2016 | Connaughton et al. | |
| 2004/0009729 | A1 * | 1/2004 | Hill | D03D 11/00 442/181 |
| 2007/0220673 | A1 * | 9/2007 | Nichols | A41D 31/125 5/944 |
| 2008/0127414 | A1 * | 6/2008 | Allen | A47G 9/062 5/420 |
| 2009/0163099 | A1 * | 6/2009 | Ackroyd | D04B 9/00 427/331 |
| 2012/0198617 | A1 * | 8/2012 | Hart | A47G 9/0292 5/493 |
| 2014/0342118 | A1 * | 11/2014 | Connaughton | A63B 6/00 428/218 |
| 2015/0167210 | A1 * | 6/2015 | Tomlin | D02G 3/04 139/420 R |
| 2015/0321047 | A1 * | 11/2015 | Whiteley | A47G 27/0237 5/417 |
| 2015/0361596 | A1 * | 12/2015 | Valérie | D02G 3/442 428/36.1 |
| 2016/0030799 | A1 | 2/2016 | Sutherland | |
| 2016/0058215 | A1 | 3/2016 | Meyer | |
| 2016/0114551 | A1 * | 4/2016 | Abrahams | B32B 5/26 428/136 |
| 2016/0287472 | A1 * | 10/2016 | Starzhynskaya | A63B 21/4037 |
| 2017/0072253 | A1 | 3/2017 | Tsai | |
| 2017/0319896 | A1 | 11/2017 | Kramer | |
| 2018/0250549 | A1 | 9/2018 | Paton | |

* cited by examiner

ANTI-SLIP YOGA RUGS

CROSS-REFERENCE TO RELATED APPLICATION AND PRIORITY CLAIM

This application claims the benefit of U.S. Provisional Patent Application No. 62/376,099, filed Aug. 17, 2016, entitled "Anti-Slip Yoga Rugs," which is herein incorporated by reference in its entirety, as if fully set forth below. This application further claims the benefit of U.S. Non-Provisional Application Ser. No. 15/678,359, filed Aug. 16, 2017, entitled "Anti-Slip Yoga Rugs," which is herein incorporated by reference in its entirety, as if fully set forth below.

FIELD OF THE INVENTION

The invention relates to an anti-slip surface for use in the practice of yoga. Specifically, the invention relates to non-slip yoga towels and rugs.

BACKGROUND OF THE INVENTION

Yoga is becoming increasingly popular in the United States and around the world as a means for improving not only the physical fitness, but also the mental and spiritual well-being of those who practice it. Recent years have seen multiple forms of yoga being practiced in heated and non-heated rooms. The physical exertion of yoga practice causes most participants to perspire heavily, with their perspiration dripping on their yoga mats and creating a risk of participants slipping as they practice.

To reduce the chance of slipping and resulting annoyance, distraction, or injury, many participants cover all or a portion of their mats with a towel or rug to absorb the perspiration. The towels can be effective; however, many times they too can slip under the lateral forces generated in holding or moving between some postures.

In response to these problems, a form of yoga towel, marketed under the YOGIETOES trademark was developed and patented as U.S. Pat. Nos. 6,961,969; 7,069,607; and 7,137,157. This yoga towel, which is formed of a synthetic microfiber, includes a gridded pattern of raised rubber-like dots or nodules bonded to its backside. The raised rubber-like dots contact the top surface of a yoga mat during use, reducing chances of the towel slipping.

Although the YOGIETOES yoga towel was an improvement over towels without the special backing, the present inventor has recognized that it has at least three problems. The first problem is that its microfiber material, a blend of 80% polyester and 20% nylon, tends to be slippery when dry. This is particularly troublesome at the start of a yoga practice before the fabric becomes wet with perspiration. The second problem is that because the towels are slippery when dry, many users spray or pour water on the topside of the towel to improve traction, not only wasting time and water, but also making the towel inconvenient to use and limiting further absorption capabilities. The third problem is that the microfiber material is thin and lightweight, and prone to folding, bulging, or curling during use as users feet sometimes drag or catch the mat. To avoid tripping on these folds and bulges alert users repeatedly re-adjust their yoga towels over the course of a practice session, distracting and interrupting them from achieving the benefits of yoga that they desire.

SUMMARY OF THE INVENTION

The foregoing problems are addressed by the anti-slip yoga rug in accordance with the present invention.

The present invention is generally directed to an anti-slip yoga rug that includes a fabric weave that may be a woven material that may absorb sweat or water. In one embodiment of the present invention, the anti-slip yoga rug may include a topside grip that may prevent or minimize slipping or other movement of the user during a yoga practice. The topside grip may include an anti-slip material that may be woven into the fabric weave. The anti-slip yoga rug may further include an edger to stabilize the anti-slip yoga rug and prevent bunching, folding, or bending of the fabric weave. The anti-slip yoga rug may also include a bottom-side grip that may prevent or minimizing slipping of the anti-slip yoga rug relative to the mat or floor. The bottom-side grip may include an anti-slip material that may be adhered to the edger. The anti-slip yoga rug may further include a grommet to hang or store the anti-slip yoga rug. The grommet may also be used to focus the gaze of the user and assist in balance during a yoga practice. The anti-slip yoga rug may include a pocket to safely store one or more personal items.

These and other features will be disclosed in the accompanying drawings and in the Detailed Description.

BRIEF DESCRIPTION OF THE DRAWINGS

For a better understanding of the invention, and to show how the same may be carried into effect, reference will now be made, by way of example, to the accompanying drawings, in which.

DETAILED DESCRIPTION OF THE INVENTION

The Ridgeback™ yoga rug of the present invention is an innovative solution to known problems, compiling form and function equally to the universal problems of slippage, fidgeting, sweat wicking, absorption, hygienic, and other distractions that may occur during a yoga practice. The Ridgeback™ yoga rug or anti-slip yoga rug embodies multiple features listed below, which may allow the rug to resist movement throughout an entire yoga/fitness practice. The one or more features below may, additionally or alternatively, prevent the user from slipping on top of the rug as they hold their yoga/fitness positions.

Figure 1:
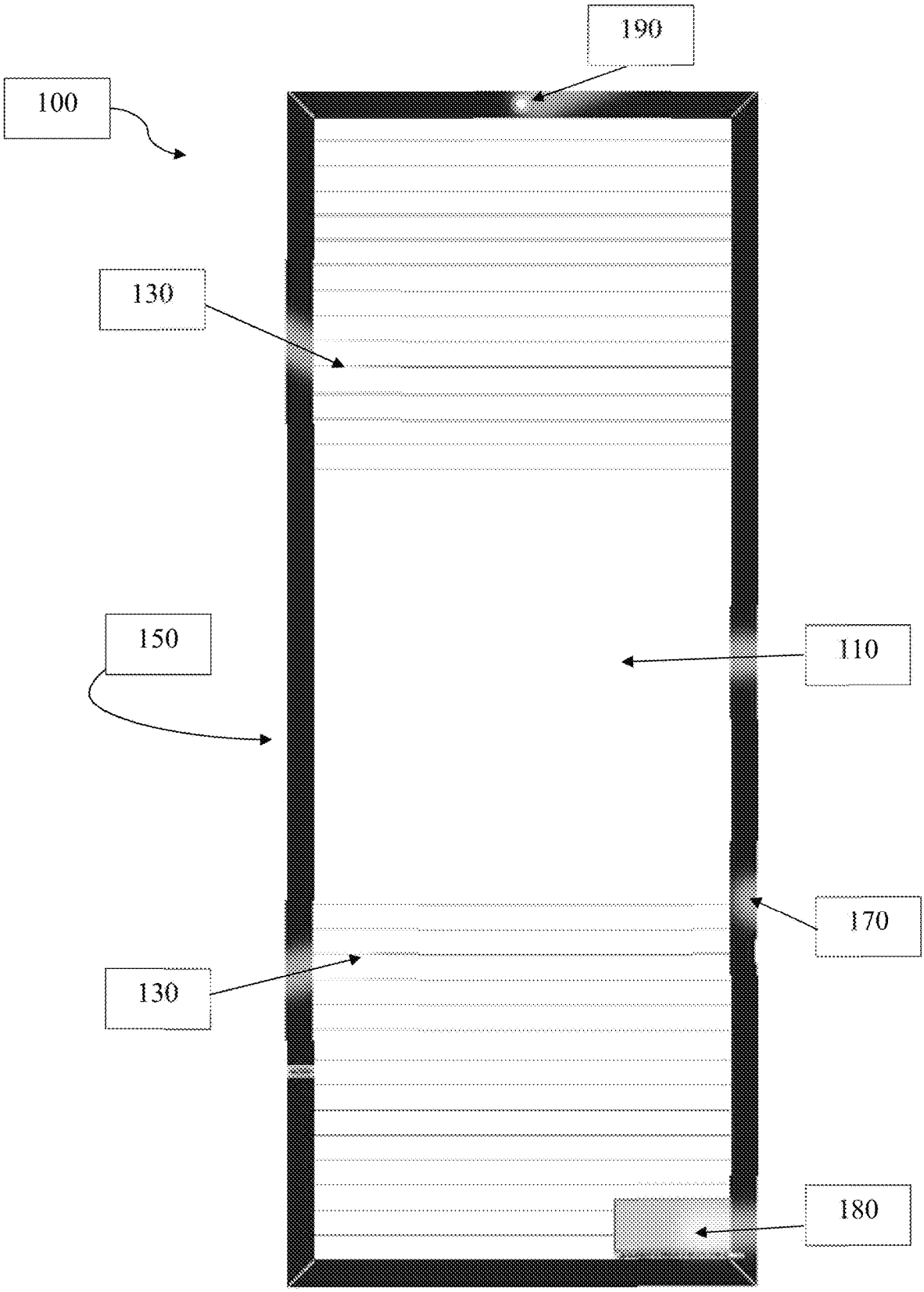
FIG. 1 is a perspective view of an anti-slip yoga rug, in accordance with an aspect of the present invention.

Referring generally to FIG. 1, the anti-slip yoga rug 100, in accordance with the invention, is illustrated. In most embodiments, the anti-slip yoga rug 100 may be generally rectangular in design and structure. However, in other embodiments, the design and structure is not so limited. In some embodiments, the anti-slip yoga rug 100 may, additionally or alternatively, be comprised of one or more shapes including, but not limited to, square, circle, oval, octagon, pentagonal, triangular, any other suitable shape, or any combination thereof. In several embodiment, the anti-slip yoga rug 100 is designed to lay over a yoga/fitness mat. In another embodiment, the anti-slip yoga rug 100 may be used as a stand-alone, without a mat underneath. As may be appreciated, the anti-slip yoga rug 100 may be laid on top of or used on or with a variety of surfaces, including but not limited to, a yoga mat, fitness mat, carpet, wood floor, any other suitable material or flooring, or any combination thereof. As may be appreciated, this rug could also be used as a meditation rug. In most embodiments, the anti-slip yoga rug 100 may broadly include, but is not limited to, a fabric weave 110, a topside grip 130, and a bottom-side grip 150 (best seen in FIG. 6), an edger 170, a pocket 180, and a grommet 190. As may be appreciated, in various embodiments, one or more of these features may not be present.

The fabric weave 110 may absorb or otherwise wick sweat away from a user. The fabric weave 110 may, additionally or alternatively, provide a user with a natural grip during their practice, which may reduce or minimize slipping. The fabric weave 110 may be hand woven, machine woven, or some combination thereof.

Figure 2:
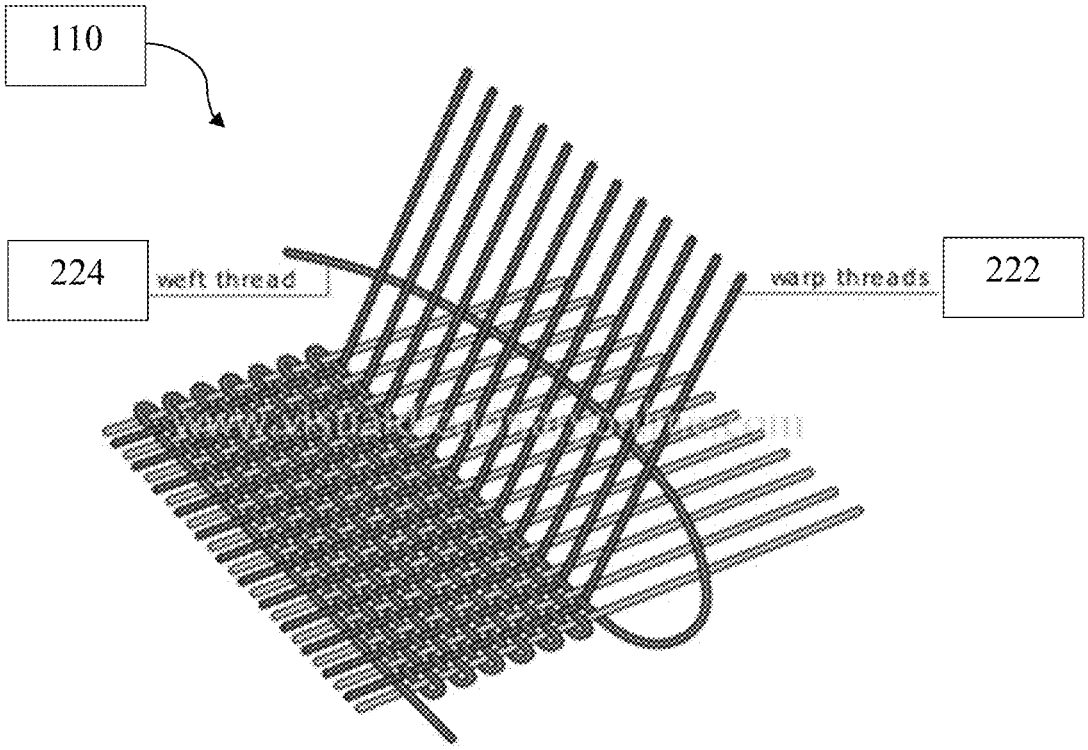
FIG. 2 is a three dimensional perspective of a weft and warp of the anti-slip yoga rug, in accordance with an aspect of the present invention.

Referring now to FIG. 2, the fabric weave 110 may be comprised of an absorbent rug or towel structure having a base layer warp 222 and/or weft 224. As may be appreciated by one in the art, the warp 222 and weft 224 may pass over and under each other, respectively, in order to create the fabric weave 110 of the anti-slip yoga rug 100. In some embodiment, the warp 222 and weft 224 of the fabric weave 110 may generally be comprised of one or more fibers or threads. In various embodiments, the one or more fibers or threads of the warp 222 may run the length of the anti-slip yoga rug 100. In some embodiments, the warp 222 may run in any suitable direction. In various embodiments, the one or more fibers or threads of the weft 224 may run the width of the anti-slip yoga rug 100. In some embodiments, the weft 224 may run in any suitable direction. In various embodiments, the warp 222 and weft 224 may be generally woven perpendicular to each other. However, in some embodiments, the warp 222, weft 224, or both may be woven horizontally, vertically, circular, in some other suitable manner, or some combination thereof. In some embodiments, the warp 222 and weft 224 may be woven as a three ply fabric weave 110. In other embodiments, the fabric weave 110 may be one ply, two ply, four ply, five ply, or more. In various embodiments, the warp 222 and weft 224 may be woven to create a generally rectangular fabric weave 110. However, as may be appreciated, the warp 222 and weft 224 may be woven to create any suitable shape.

In several embodiments, the fibers or threads of the anti-slip yoga rug 100 may be comprised of natural fibers. In some embodiments, the fibers or threads may be comprised of cotton. In some embodiments, the fibers or threads of the fabric weave 110 may, additionally or alternatively, be comprised of hemp, bamboo, soy, silk, linen, any other suitable natural fiber, or any combination thereof. In some embodiments, the fibers or threads of the anti-slip yoga rug 100 may, additionally or alternatively, be comprised of one or more synthetic fibers or materials. For example, and without limitation, the one or more synthetic fibers or materials may include rayon, polyester, nylon, fleece, plastic, rubber, PVC, Vinyl, any other suitable material, or any combination thereof. In various embodiments having two or more ply's, one or more of the individual ply's may be a natural and/or synthetic fiber and one or more ply's may be an alternative material thread comprised of elastic, rubber, PVC, Vinyl, silicone, EPDM or other anti-slip fibers.

In various embodiments, the fabric weave 110 may include an antimicrobial, an antibacterial, a deodorizer, or some combination thereof. In some embodiments, the antimicrobial, antibacterial, or deodorizer may be comprised of a natural fiber or material, including but not limited to silver. In other embodiments, other materials may, additionally or alternatively, be used, including but not limited to, stainless steel. In still other embodiments, the fabric weave 110 may, additionally or alternatively, be treated to include one or more of these features or other desired properties.

In some embodiments, the fabric weave 110 may, additionally or alternatively, include a cooling activation material, a warming activation material, or both. An example of, but not limiting too, a cooling material fabric would be the use of 'Ice Cotton" or "Stanford Material" that would act as the base alternative material as the warp and weft of the anti-slip yoga rug/towel.

Topside Grip 130: Anti-slip gripper ridges/cord/thread.

Figure 3:
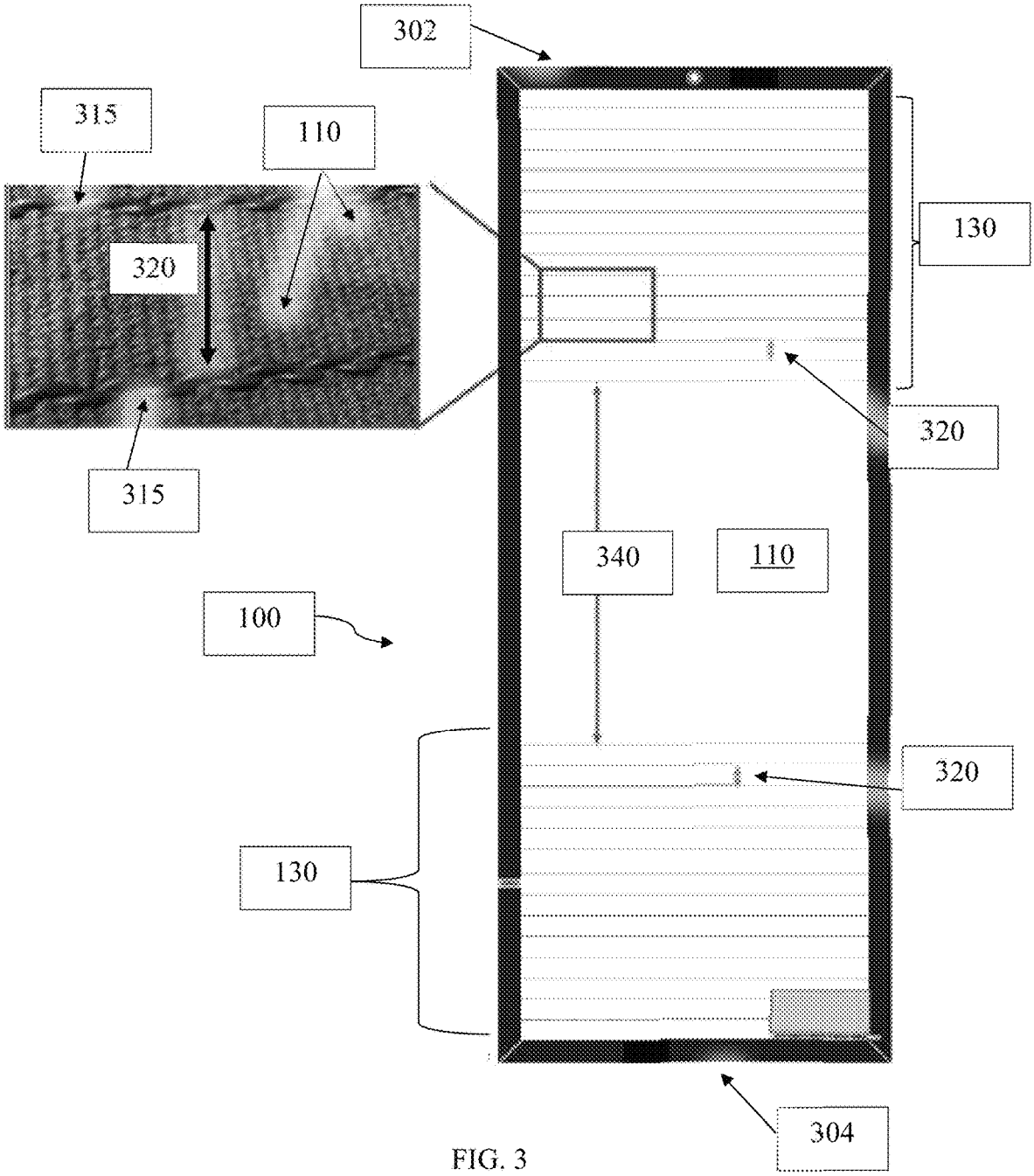
FIG. 3 is a perspective view of an anti-slip yoga rug, in accordance with an aspect of the present invention.

Referring now to FIG. 3, the topside grip 130 may provide an additional grip to prevent the user from slipping as they enter into or hold their yoga/fitness position. As seen in the magnified perspective window of FIG. 3, the topside grip 130 may be comprised of an anti-slip ridge, cord, thread, other suitable surface, or a combination thereof (herein referred to collectively as "anti-slip ridge" 315). In various embodiments, the topside grip 130 may be comprised of a plurality of anti-slip ridges 315.

In a preferred embodiment, the anti-slip yoga rug 100 may include twenty-eight anti-slip ridges 315. In one such embodiment, fourteen anti-slip ridges 315 may be generally located on or towards the front side 302 of anti-slip yoga rug 100 and fourteen anti-slip ridges 315 may be generally located on or towards the back side 304 of anti-slip yoga rug 100. In the various embodiments, the anti-slip ridges 315 may be generally separated by one or more spaces 320. In one embodiment, the space 320 between the anti-slip ridges 315 may be approximately 1.75 inches. In other embodiments, the space 320 may be greater than or less than 1.75 inches. In various embodiments, the anti-slip yoga rug 100 may additionally include a center space 340 generally void of anti-slip ridges 315. In one embodiment, the center space 340 is approximately 22.5 inches in length. In other embodiments, the space 340 may be greater than or less than 22.5 inches. In at least one embodiment, the anti-slip yoga rug 100 may not include a center space 340.

As may be appreciated, in other embodiments, the anti-slip yoga rug 100 may include greater than or less than twenty-eight anti-slip ridges 315. In some embodiments, the anti-slip ridges 315 may be spaced 320 the entire length of anti-slip yoga rug 100. In some embodiments, there may be more anti-slip ridges 315 located on or towards the front side 302 of anti-slip yoga rug 100. In other embodiments, there may be more anti-slip ridges 315 located on or towards the back side 304 of anti-slip yoga rug 100. In addition, in some embodiments, the spacing 320, 340 between anti-slip ridges 315 may not be uniform. That is, the spacing 320, 340 may generally vary between each of the anti-slip ridges 315.

In various embodiments, each of the plurality of anti-slip ridges 315 may be hand woven, machine woven, or secured using some combination thereof to the fabric weave 110. In at least one embodiment, the anti-slip ridges 315 of the topside grip 130 may be woven as part of the weft. In at least one embodiment, the anti-slip ridges 315 of the topside grip 130 may, additionally or alternatively, be woven as part of the warp. In still other embodiments, the anti-slip ridge 315 may be adhered, bonded, or fused onto the fabric weave 110. As may be appreciated, any suitable method to secure or attach the one or more anti-slip ridges 315 to the fabric weave 110 may be used.

Figure 4A:
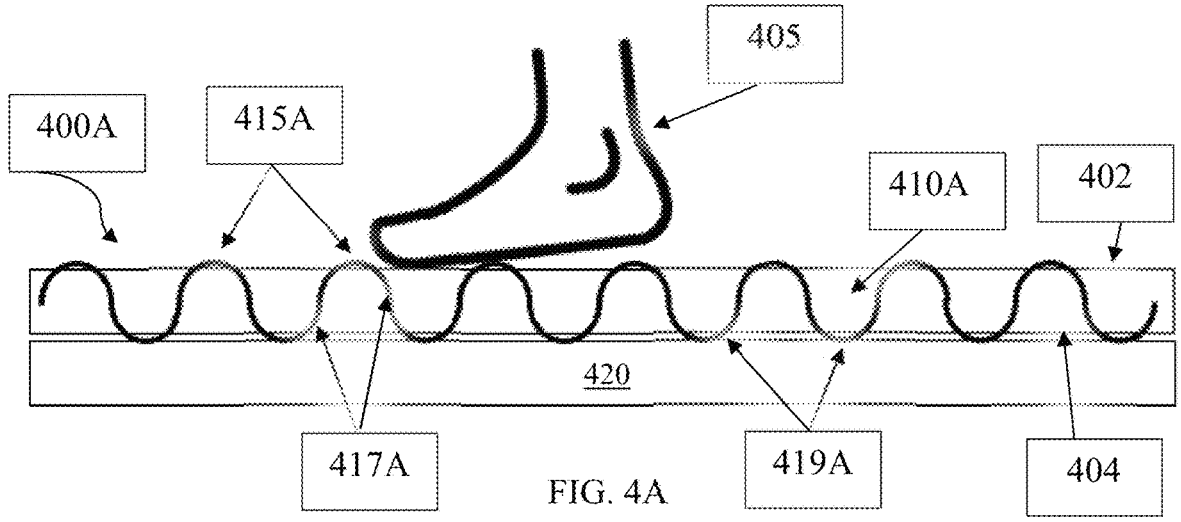
FIG. 4A is a cross-sectional perspective of an anti-slip yoga rug, in accordance with an aspect of the present invention.
Figure 4B:
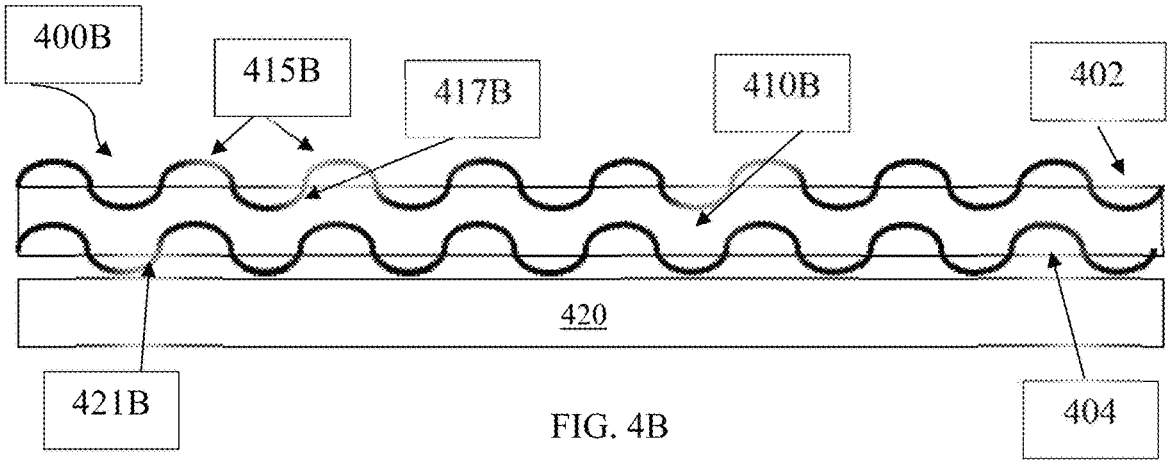
FIG. 4B is a cross-sectional perspective of an anti-slip yoga rug, in accordance with an aspect of the present invention.
Figure 4C:
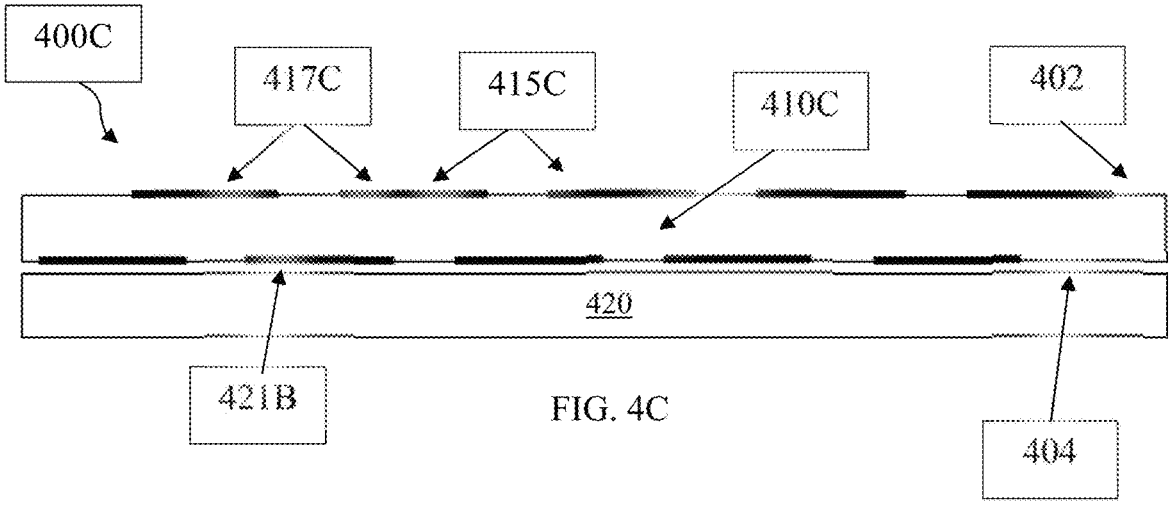
FIG. 4C is a cross-sectional perspective of an anti-slip yoga rug, in accordance with an aspect of the present invention.

Referring now to FIGS. 4A-C, the anti-slip ridge 415A, 415B, 415C may be woven into or secured to the fabric weave 410A, 410B, 410C or otherwise constructed as part of the anti-slip yoga rug 400A, 400B, 400C in a variety of ways. With reference to FIG. 4A, the anti-slip ridge 415A may generally be comprised of a continuous strand, thread, or cord 417A, that may be woven such that it may generally pass entirely through the fabric weave 410A. As may be appreciated by one in the art, one or more strands or cords 417A may, additionally or alternatively, be used. In such embodiments, a portion of the cord 417A may be generally exposed on a top side 402 of anti-slip yoga rug 400A, thereby creating the anti-slip ridge 415A that prevents the user 405 from slipping. The cord 417A may pass through the fabric weave 410A such that another portion 419A is generally exposed on a bottom side 404 of anti-slip yoga rug 400A, which may comprise the bottom-side grip (discussed more below).

In other embodiments, and with reference to FIG. 4B, the cord 417B may, additionally or alternatively, be woven such that it may not pass entirely through the fabric weave 410B. In such embodiments, a portion of the cord 417B may be generally exposed on a top side 402 of anti-slip yoga rug 400B, thereby creating the anti-slip ridge 415B. However, the rest of the cord 417B may not be substantially exposed; for example, at least a portion of cord 417B may be enclosed or located within the fabric weave 410B.

In some embodiments, and with reference to FIG. 4C, the anti-slip ridge 415C may, additionally or alternatively, consist of one or more cords 417C that may be adhered, bonded, fused, or otherwise attached onto the top side 402 of anti-slip yoga rug 400C.

Figure 5:
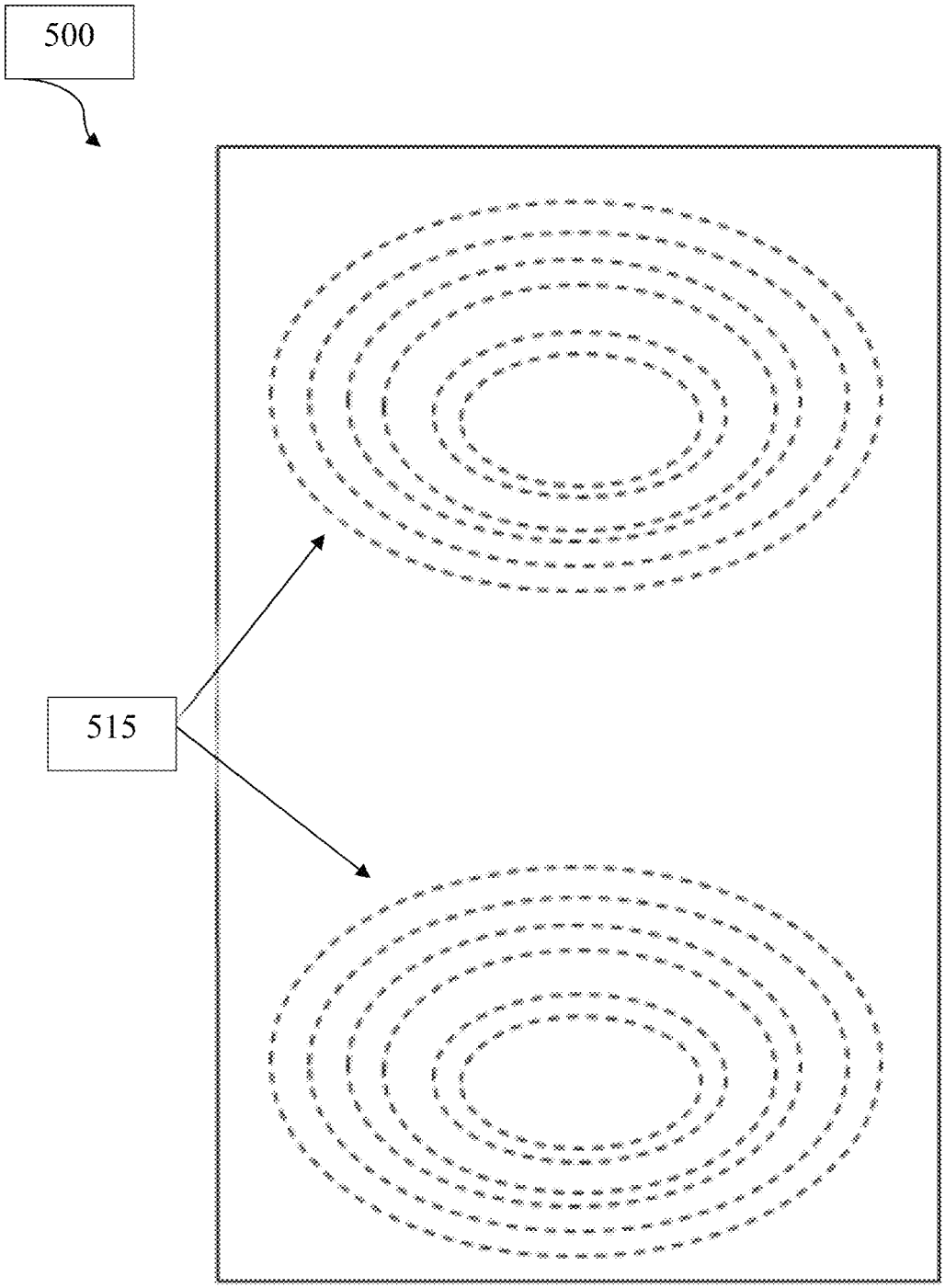
FIG. 5 is a perspective view of an anti-slip yoga rug, in accordance with an aspect of the present invention.

In various embodiments, the anti-slip ridge 315, 415A-C may run horizontally, vertically, or obliquely relative to the length dimension of the anti-slip yoga rug 100, 400A-C. In some embodiments, one or more of the anti-slip ridges may be generally woven across the entire anti-slip yoga rug; from one peripheral edge to the opposing peripheral edge. In some embodiments, one or more of the anti-slip ridges may be woven such that they span a distance less than the entire length or width of the anti-slip yoga rug. In some embodiments, and with reference to FIG. 5, the anti-slip ridges 515 may, additionally or alternatively, create a generally circular pattern on the anti-slip yoga rug 500.

In some embodiments the topside grip may take other forms, including but not limited to, a piled, sheared, turfed, a woven pattern, a random woven arrangement, any other suitable form, or any combination thereof. As may be appreciated, any suitable design or shape may be used.

As may be appreciated, the anti-slip ridges of the topside grip may be comprised of a material that is anti-slip, i.e., a material having a texture or shape that may prevent or minimize slipping. In a preferred embodiment, the anti-slip ridges 315, 415A-C, 515 of the topside grip 130 may be comprised, at least in part, of EPDM rubber. In at least one embodiment, the EPDM may include a UV protectant, which may promotes durability. In various embodiments, the anti-slip ridges 315, 415A-C, 515 of the topside grip 130 may, additionally or alternatively be comprised of Buna, Silicone, elastic, latex, any other thermos-elastic material, PVC, vinyl, recycled rubber, non recycled rubber, Jute, recycled yoga/fitness mats, any other suitable material, or any combination thereof.

In some embodiments, the topside grip 130 may be comprised of multiple strands or threads of Buna, silicone, EPDM rubber or other thermoelastic material interwoven into the fabric weave 110, 410A-C. In some embodiments, one or more of the strands or cords are formed of Nitrile rubber, also known as Buna-N, Perbunan, acrylonitrile butadiene rubber, and NBR. More generally, these are synthetic rubber copolymers of acrylonitrile (ACN) and butadiene. Some other trade names of these materials include Nipol, Krynac and Europrene. Silicone refers to polymers that include any inert, synthetic compound made up of repeating units of siloxane, which is a chain of alternating silicon atoms and oxygen atoms, frequently combined with carbon and/or hydrogen. Natural rubbers or other materials having a higher coefficient of friction than the fabric weave 110, 410A-C are used in other embodiments. In various embodiments, the material comprising the fabric weave 110, 410A-C may have a generally higher absorbency than the topside grip 130. In other embodiments, the material comprising the topside grip 130 may have the same or higher absorbency as the fabric weave 110, 410A-C.

In some embodiments, the anti-slip ridge 315 of the top-side grip 130 may generally protrude out from the fabric weave 110, thereby creating a ridge or other surface to assist in preventing or minimizing slipping. In other embodiments, the anti-slip ridge 315 may be flush with the fabric weave 110.

In various embodiments, and with reference back to FIG. 1, the anti-slip yoga rug 100 may include an edger 170. The edger 170 may wrap around one or more borders or edges of the fabric weave 110. The edger 170 may, additionally or alternatively, secure the weave of the fabric weave 110, topside grip 130, and bottom-side grip 150. The edger 170 may, additionally or alternatively, assist in preventing or minimizing the anti-slip yoga rug 100 from moving during a user's practice or fitness routine. The edger 170 may, additionally or alternatively, prevent or minimize the anti-slip yoga rug 100 from peeling from the corners or edges, bunching, folding, or any combination thereof. In at least one embodiment, the edger 170 may, additionally or alternatively, prevent or minimize the user from slipping on the anti-slip yoga rug 100. For example, the edger 170 may include a gripper tape (discussed more below) or some other anti-slip fabric, material, or property. In addition, the edger 170 may assist in withstanding pressure and other forces involved in washing the anti-slip yoga rug 100. That is, the edger 170 may generally assist in the lasting durability of the anti-slip yoga rug 100. As may be appreciated, in some embodiments, the edger 170 may not be present.

In various embodiments, the edger 170 may be comprised of a polyester grosgrain. In some embodiments, the edger 170 may, additionally or alternatively, be comprised of one or more materials including, but not limited to, nylon, rayon, PVC, vinyl, fleece, natural or organic cotton, patterned trim borders that are handwoven, scraps of recycled denim, cotton, poly/tri/quad blends, any other suitable material, or any combination thereof.

In some embodiments the edger 170 may be sewn or stitched onto the fabric weave 110, which may assist in preventing fraying. The edger 170 may, additionally or alternatively, secure the topside grip 130 and bottom-side grip 150 (discussed below).

Figure 6:
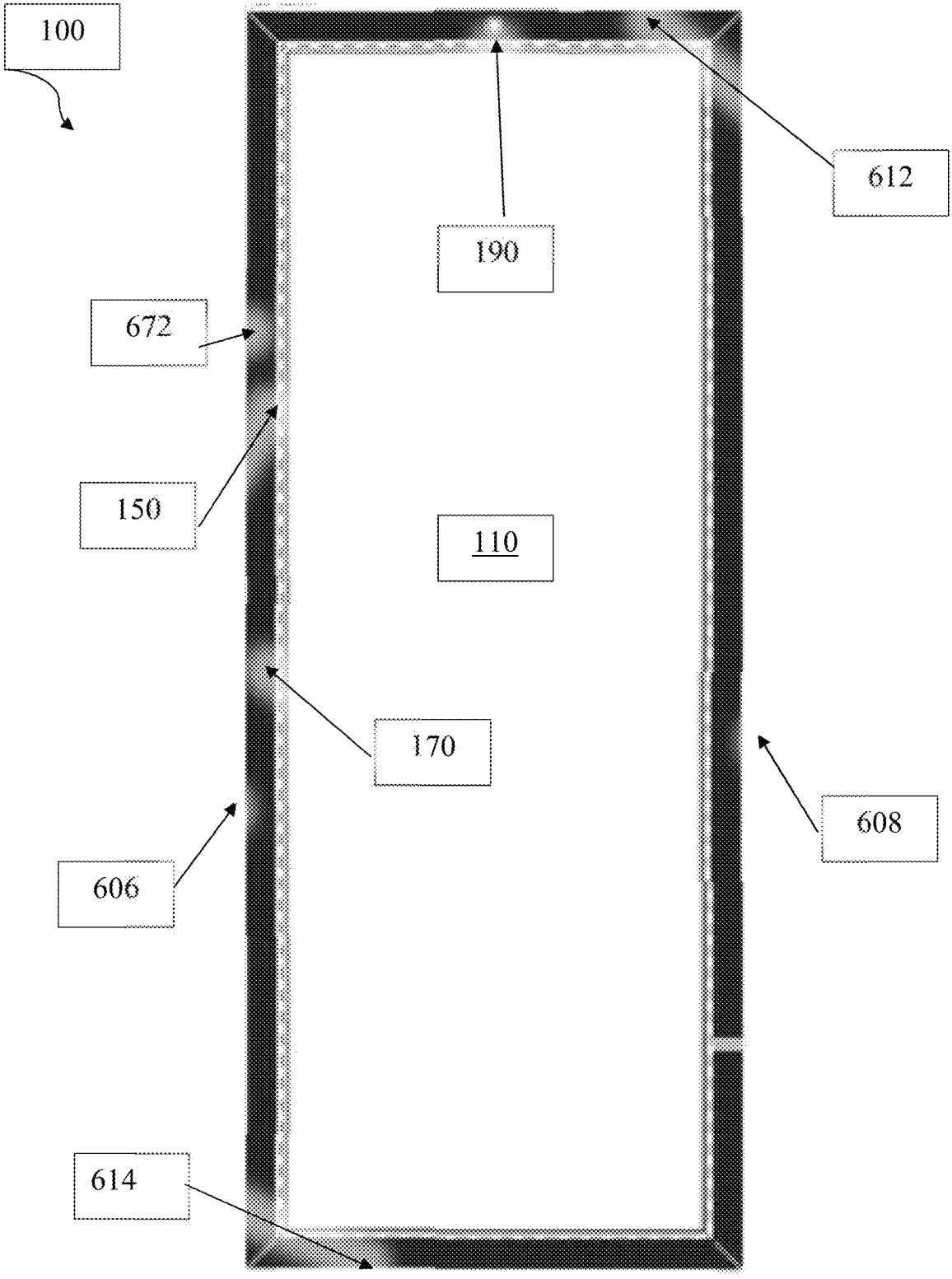
FIG. 6 is a perspective view of an anti-slip yoga rug, in accordance with an aspect of the present invention.

With reference now to FIG. 6, the bottom of the anti-slip yoga rug 100, including the bottom-side grip 150, is illustrated. The bottom-side grip 150 may assist in preventing or minimizing movement of the anti-slip yoga rug 100 relative the floor, yoga mat, or other surface during a user's practice or fitness routine. In various embodiments, the bottom-side grip 150 may consist of an anti-slip material attached, secured, or otherwise connected to the fabric weave 110, edger 170, other suitable surface, or any combination thereof.

In some embodiments, as seen in FIG. 6, the bottom-side grip 150 may be generally circumferentially positioned. That is, in some embodiments, the bottom-side grip 150 may be positioned on the lengthwise edges 606, 608 and widthwise edges 612, 614. In other embodiments, one or more edges 606, 608, 612, 614 may not include a bottom-side grip 150. In still other embodiments, the bottom-side grip 150 may, additionally or alternatively, exist at one or more points between lengthwise edges 606 and 608 and/or between widthwise edges 612 and 614. That is, the bottom-side grip 150 may run lengthwise, widthwise, diagonally, or some other direction between the one or more edges 606, 608, 612, and 614. As may be appreciated, the anti-slip yoga rug of the present invention may be any shape, and therefore may include more edges or less edges. However, it may be appreciated, the bottom-side grip 150 may still be generally positioned circumferentially, across the one or more edges, or any other suitable arrangement or combination. In various embodiments, the bottom-side grip 150 may include a design, pattern, any other suitable arrangement, or any combination thereof.

Figure 7:
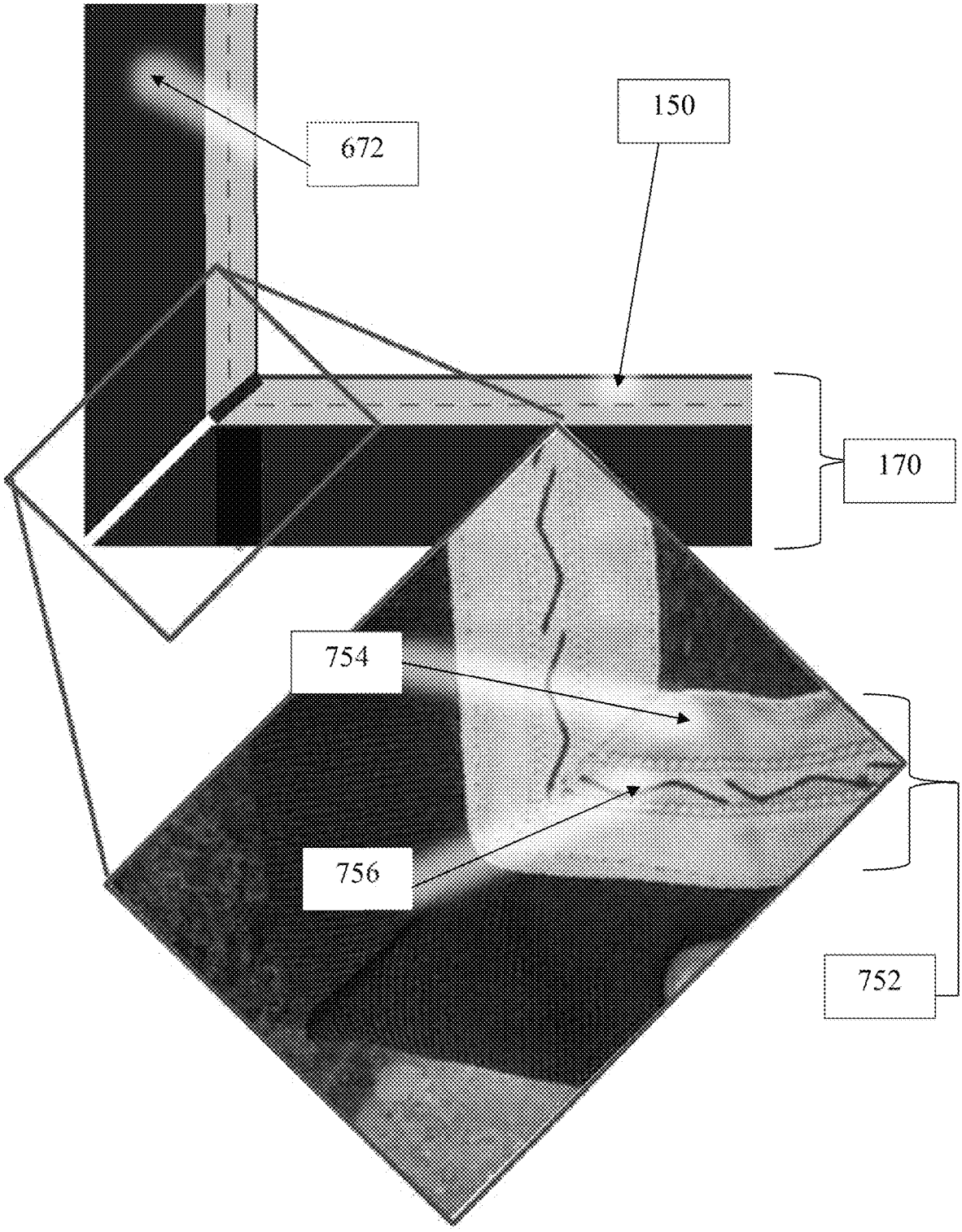
FIG. 7 is a perspective view of an edger/border system, in accordance with an aspect of the present invention.

In some embodiments, the bottom-side grip 150 may be attached, secured, or adhered to the floor or mat facing side 672 of edger 170. Any suitable method to connect the bottom-side grip to the edger 170 may be used. With reference to FIG. 7, the bottom-side grip 150 may, in some embodiments, be comprised of a gripper tape 752. In some embodiments, the gripper tape 752 may be comprised of a canvass fabric 754 and a grip 756. In various embodiments, the grip 756 may be mechanically connected to the canvass fabric 754. For example, the grip 756 may be adhered or glued onto canvass fabric 754. In other embodiments, the grip 756 may, additionally or alternatively, be printed onto canvass fabric 754. In other embodiments, the grip 756 may, additionally or alternatively, be stitched into canvass fabric 754. In still other embodiments, the grip 756 may, additionally or alternatively, be heat transferred onto canvass fabric 754. The canvass fabric 754 may be sewn, stitched, heat transferred, printed, glued or adhered, connected in some other suitable manner, or some combination thereof to the mat facing side 672 of edger 170. As may be appreciated, in some embodiments, the canvass fabric 754 may not be present and the grip 756 may be connected directly to the mat facing side 672 of edger 170.

In other embodiments, and as seen in FIGS. 4A-C, the bottom-side grip may, additionally or alternatively, be woven into or otherwise connected to the fabric weave 410A-C. For example, and with reference to FIG. 4A, the bottom-side grip may, in some embodiments, be comprised of portion 419A of cord 417A, which may be generally exposed on a bottom side 404 of anti-slip yoga rug 400A. In another example, and with reference to FIG. 4B, the bottom-side grip may, in some embodiments, be comprised of a bottom-side grip cord 421B that may be woven into the fabric weave 410B such that at least part of the bottom-side grip cord 421B may be generally exposed on a bottom side 404 of anti-slip yoga rug 400B. In still another example, and with reference to the embodiment shown in FIG. 4C, the bottom-side grip may, additionally or alternatively, be comprised of a bottom-side grip cord 421C that may be adhered, bonded, fused, heat-transferred, or otherwise attached onto the bottom side 404 of anti-slip yoga rug 400C. As may be appreciated, any suitable method to affix, attach, or secure the bottom-side grip to the anti-slip yoga rug may be used.

With general reference to FIGS. 6 and 7, the bottom-side grip 150 may, in some embodiments, be comprised of one or more dashed lines. However, in other embodiments, the bottom-side grip 150 may, additionally or alternatively, be comprised of one or more solid lines. In still other embodiments, the bottom-side grip 150 may, additionally or alternatively, be comprised of one or more patterns, including but not limited to, circles, zig-zags, crosses, any other suitable pattern, or any combination thereof. In some embodiments, the bottom-side grip 150 may, additionally or alternatively, be random in design.

In various embodiments, the canvass fabric 754 may be comprised of cotton, spandex, polyester, nylon, rayon, linen, silk, satin, denim, jute, any other woven fabric, any other suitable material, or any combination thereof. In at least one embodiment, the gripper tape 752 is elastic. In one such embodiment, the canvass fabric 754 may, additionally or alternatively, include elastic. In various embodiments, the grip 756 may be comprised of silicone, EPDM, Buna, elastic, latex, PVC, vinyl, rubber, any other thermos-elastic material, any other suitable material, or any combination thereof.

In some embodiments the canvass fabric, grip or both may not be present. In such embodiments, a suitable bottom-side grip 150 may, additionally or alternatively, include, but is not limited to, cotton, spandex, polyester, nylon, rayon, linen, silk, satin, denim, silicone, silver thread, jute, stainless steel thread, or any polymer sticky material or natural woven fabric either designed in a pattern or individual placement. In various embodiments, the bottom-side grip 150 may, additionally or alternatively, include but is not limited to, EPDM, Buna, Silicone, elastic, latex, any other thermos-elastic material, PVC, vinyl, recycled rubber, non recycled rubber, Jute, recycled yoga/fitness mats, any other suitable material, or any combination thereof. As may be appreciated, any suitable design and material may be used. In addition, any suitable method to secure or affix the bottom-side grip 150 to the edger 170 or fabric weave 110 may be used.

In various embodiments, and with reference to FIG. 1, a pocket 180 may provide a spot for a user to generally secure one or more items, for example and example only, not limited to store jewelry, keys, studio/gym pass, wallet, and/or mobile phone. The pocket 180 may generally be used to safely store these items from sweat, water, theft, or for any other suitable purpose. In at least one embodiment, the pocket 180 may be approximately 4.25 inches in width and 7.5 inches in length. However, as may be appreciated, the pocket 180 may be of any suitable size or dimension.

The pocket 180 may be generally positioned along one or more edges of the anti-slip yoga rug 100. In some embodiments, the pocket 180 may be generally positioned near the front of the anti-slip yoga rug 100. In other embodiments, the pocket 180 may, additionally or alternatively, be generally positioned near the back of the anti-slip yoga rug 100. In most embodiments, the pocket 180 may be positioned on the topside of the anti-slip yoga rug 100. In other embodiments, the pocket 180 may be positioned on the bottom-side of the anti-slip yoga rug 100. For example, in some embodiments the pocket 180 may be positioned in the bottom right hand corner, bottom left hand corner, top left hand corner, top right hand corner, or at some location in the middle of the anti-slip yoga rug. In at least one embodiment, the pocket 180 may be located at least partially within the edger 170. As may be appreciated, the pocket 180 may be positioned at any suitable location.

Figure 8:
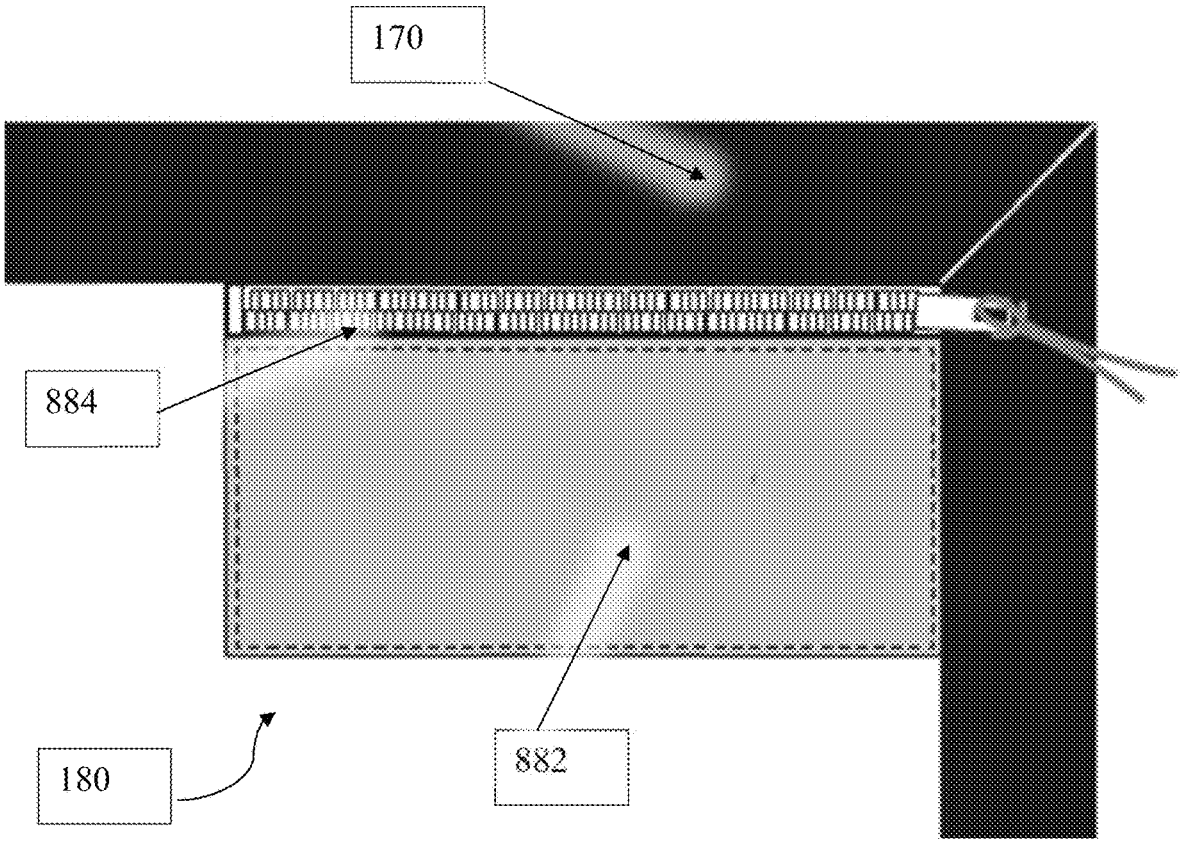
FIG. 8 is a perspective view of a pocket, in accordance with an aspect of the present invention.

In various embodiments, and with reference to FIG. 8, the pocket 180 may include a shell 882. In some embodiments the shell 882 material may include, but is not limited to Ripstop Nylon, 70 Denier, Nylon, DWR finish, a urethane coating, any other suitable material, or any combination thereof. In at least one embodiment, the shell 882 may be water resistant. In at least one embodiment, the shell 882 may, additionally or alternatively, be rip-resistant. In some embodiments the use of any variation rip stop branded material, or other variations of water resistant or waterproof treated or mill treated fabric material may be used. In one embodiment, the shell 882 may include one or more anti-slip properties. For example, the pocket may include a gripper tape, anti-slip ridge, or other suitable material or property to prevent slipping.

In various embodiments, the pocket 180 may include a closure 884. In some embodiments the closure 884 of the pocket 180 may be a YKK Metaluxe lock stop with rubber tip zipper. However, in other embodiments, the closure may comprise but is not limited to, Velcro, zip-lock slider, snap button, buttons, glue, any other suitable adhesive, any other suitable closure, or any combination thereof.

Referring back to FIGS. 1 and 6, the grommet 190 may be illustrated. In a preferred embodiment, the grommet 190 may be generally positioned at the top of the anti-slip yoga rug 100 and evenly centered between the lengthwise edges 606, 608. In this way, the grommet 190 may act as a Drishti point for focused gaze during a yoga practice. As may be appreciated, the Grommet 190 placement is for a focal gaze point or for balance. However, in other embodiments, it may not be so limited. For example, in other embodiment, the grommet 190 may be placed at the bottom or corner of anti-slip yoga rug 100. In addition, in some embodiments, two or more grommets 190 may be used. In various embodiments, the grommet may, additionally or alternatively, be used as a hook to hang or store the anti-slip yoga rug 100.

In some embodiments, the grommet 190 may be comprised of a rolled rim with a metal spur washer. In some embodiments, the grommet may be a hole or loop of any appropriate material. In various embodiments, the grommet 190 may be comprised of black oxidized brass. In other embodiments, the grommet 190 may, additionally or alternatively, include but is not limited to, copper, metal, stainless steel, plastic, ceramic, glass, any other suitable material, or any combination thereof.

In at least one embodiment, the grommet 190 may have a diameter of 9/16 of an inch. In other embodiments, the grommet 190 may have a diameter greater than or less than 9/16 of an inch.

In at least one embodiment, the grommet 190 may have a reinforced stitch of the woven warp 122 and weft 124 due to the puncturing within the borders or base rug fabric.

In some embodiments, a loop may, additionally or alternatively, be used. The loop may be woven into, sewn or stitched, or otherwise connected to the fabric weave 110 or edger 170. The loop may also provide a point Those skilled in the art will also appreciate further features and advantages of the invention based on the above-described aspects. Accordingly, the invention is not to be limited by what has been particularly shown and described.

While the present disclosure has been described in connection with a plurality of exemplary aspects, as illustrated in the various figures and discussed herein, it is understood that other similar aspects or features may be used and modifications and additions may be made without deviating from the scope of the present invention. For example, various features may have been described in particular detail with respect to one aspect of the present disclosure, but such features may be present or incorporated into other aspects described herein without deviating from the scope of the invention contemplated by the present disclosure. The aspects above are intended to be illustrative and not limiting. Additional aspects are within the scope of the claims. Moreover, the aspects and features of the aspects described herein are not mutually exclusive.

In addition, persons of ordinary skill in the art may recognize that the invention may comprise fewer features than illustrated or described in any individual aspect disclosed herein. The aspects are not meant to be exhaustive of the ways in which the various features described herein may be combined or used. The present disclosure should not be limited to any single aspect or aspect.

What is claimed is:

1. An anti-slip yoga rug comprising:

a fabric weave consisting of a thread having a plurality of plys, at least one ply including an anti-microbial stainless steel fiber, the fabric weave including a weft and a warp;

a plurality of anti-slip grips woven through the fabric weave and spaced at least one inch apart, each anti-slip grip comprised of a rubber anti-slip material and including an upper grip and a lower grip, the upper grip at least partially exposed on a top-side of fabric weave and configured to provide a first anti-slip surface configured to reduce the slipping of a user with respect to the anti-slip yoga rug, the lower grip at least partially exposed on a bottom-side of a fabric weave and configured to provide a second anti-slip surface configured to reduce the slipping of the anti-slip yoga rug with respect to a ground surface; and a bottom-side grip mechanically connected to an underside of the anti-slip yoga rug and configured to interact with the ground surface to provide a third anti-slip surface configured to reduce the slipping of the anti-slip yoga rug with respect to the ground surface.

2. The anti-slip yoga rug of claim 1, wherein the fabric weave includes a cotton fiber.

3. The anti-slip yoga rug of claim 1, wherein one or more of the plurality of anti-slip grips is further comprised of at least two rubber strands.

4. The anti-slip yoga rug of claim 1, wherein the plurality of anti-slip grips is further comprised of a first plurality of anti-slip grips on a first end of the anti-slip yoga rug and a second plurality of anti-slip grips on a second end of the anti-slip yoga rug.

5. The anti-slip yoga rug of claim 1, wherein the bottom-side grip is comprised of rubber.

6. The anti-slip yoga rug of claim 1, wherein the bottom-side grip is comprised of latex.

7. The anti-slip yoga rug of claim 1, wherein each anti-slip grip includes plastic.

8. The anti-slip yoga rug of claim 1, wherein each anti-slip grip includes recycled mats.

9. The anti-slip yoga rug of claim 1, wherein each anti-slip grip includes silicone.

10. The anti-slip yoga rug of claim 1, wherein each anti-slip grip includes EDPM rubber.

11. The anti-slip yoga rug of claim 1, wherein each anti-slip grip includes elastic material.

12. The anti-slip yoga rug of claim 1, wherein the fabric weave includes a hemp fiber.

13. The anti-slip yoga rug of claim 1, wherein the fabric weave includes a bamboo fiber.

14. The anti-slip yoga rug of claim 1, wherein the bottom-side grip is adhered to the anti-slip grip.

15. The anti-slip yoga rug of claim 1, wherein the bottom-side grip is comprised of at least one of plastic or silicon.

* * * * *